United States Patent [19]

Droz et al.

[11] 4,028,878

[45] June 14, 1977

[54] CONTROL DEVICE FOR AN ELECTRONIC WRIST WATCH

[75] Inventors: Willy Droz, Hauterive; Jean-Luc Beguin, Neuchatel, both of Switzerland

[73] Assignee: Ebauches S.A., Neuchatel, Switzerland

[22] Filed: Nov. 25, 1975

[21] Appl. No.: 635,090

[30] Foreign Application Priority Data

Dec. 11, 1974 Switzerland ..... 16372/74

[52] U.S. Cl. ..... 58/23 R; 58/50 R; 307/247 A

[51] Int. Cl.[2] ..... G04C 3/00

[58] Field of Search ..... 58/23 R, 50 R, 85.5; 307/247 A, 269

[56] References Cited

UNITED STATES PATENTS

| | | | |
|---|---|---|---|
| 3,810,356 | 5/1974 | Fujita | 58/23 R |
| 3,823,550 | 7/1974 | Bergey | 58/50 R |
| 3,852,950 | 12/1974 | Yoda et al. | 58/85.5 X |
| 3,871,168 | 3/1975 | Marie et al. | 58/23 R |
| 3,921,385 | 11/1975 | Harding et al. | 58/50 R |

*Primary Examiner*—Ulysses Weldon
*Attorney, Agent, or Firm*—Imirie, Smiley & Linn

[57] ABSTRACT

A control device for an electronic wrist watch to enable selection of a variety of possible displays. The circuit of the device incorporates means for memorizing an input control signal derived from a pushbutton and logic and delay means for combining the input control signal and the information in the memory means to provide outputs according to the period for which the pushbutton is actuated. The outputs can be used to selectively connect counters to the display means of the watch.

6 Claims, 4 Drawing Figures

CONTROL DEVICE FOR AN ELECTRONIC WRIST WATCH

BACKGROUND OF THE INVENTION

The subject of the invention is a control device for electronic watches comprising a push button switch and a circuit for memorizing the input control signals derived from the pushbutton, these latter being erased from the memory, in the case where the pushbutton has been released, in synchronism with a clock signal. It also concerns a use of this device in an electronic watch having electrochromatic display.

In the control member of electronic watches, it is always advantageous to reduce to a minimum the number of mechanical devices which are subject to deterioration.

The invention has for its object a control device where, with a single push button, one can effect to the circuits of the watch two different operations in accordance with the manipulation of the push button being of short or of long duration.

SUMMARY OF THE INVENTION

According to the present invention there is provided a control device for electronic watches comprising a push button switch for providing a control signal, memory means for memorizing the control signal, which signal is erased from the memory, in synchronism with a clock signal, when the pushbutton is released, the output of the memory means is connected via a first delay means to one of the outputs of the device, and is combined with the control signal, the signal resulting from the said combination being transmitted by a second delay means to a second output of the device, the state of the two outputs of the device varying in accordance with the duration of the actuation of the pushbutton. The two output signals may be used for operating a first switch for display selection and one of the two outlet signals may be combined with the inverse of the other to operate a second display selection switch.

BRIEF DESCRIPTION OF THE DRAWINGS

The present invention will be described further, by way of example, with reference to the accompanying drawings, in which.

DETAILED DESCRIPTION OF THE DRAWINGS

Figure 1:
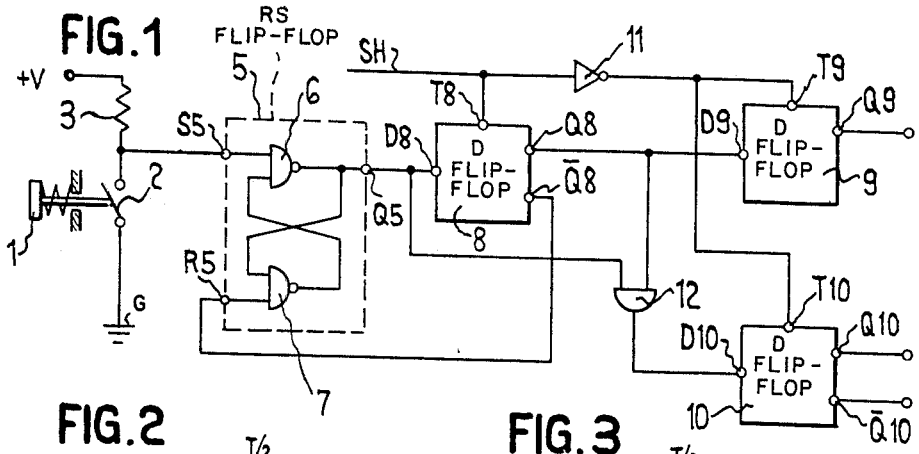
FIG. 1 shows an embodiment of device in accordance with the invention.

In FIG. 1, a push button 1 operates a switch 2. In its rest position, the switch 2 is open so that the input S5 of RS flip-flop circuit 5 is connected to a terminal having a voltage +V corresponding to a logic potential "1", via a resistance 3. In the case where the switch 2 is closed, the input S5 is connected to ground G and this input will then be at a logic potential "O". The RS flip-flop circuit 5 is composed of two NAND gates 6 and 7, the output Q5 of this flip-flop feeds the input D8 of a D flip-flop 8 the output $\bar{Q}8$ of which is connected to the input R5 of the RS flip-flop 5. The output Q8 is connected to the input D9 of a second flip-flop 9, on the other hand, the output Q8 and the output Q5 of the flip-flops 8 and 5 respectively, provide inputs to an AND gate 12, the output of which is connected to the input D10 of a third D flip-flop circuit 10. A clock signal SH of period T directly feeds the input T8 of the D flip-flop circuit 8, and via an inverter 11 is supplied to the inputs T9 and T10 of the D flip-flops 9 and 10 the outputs Q9 and Q10, respectively, of which form the output terminals of the control circuit.

Figure 2:
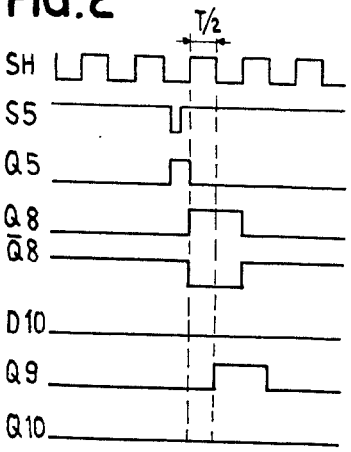
FIGS. 2 and 3 are diagrams illustrating the functioning of the device of FIG. 1.
Figure 3:
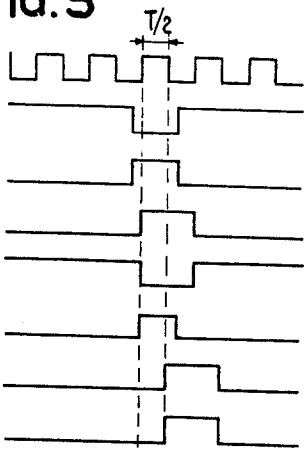

FIGS. 2 and 3 show the operation of the control circuit for a "short" impulse, on the one hand, (FIG. 2) and for a "long" impulse on the other hand (FIG. 3).

In FIG. 2 a relatively short impulse is provided by depressing the pushbutton 1 at the input S5 of the RS flip-flop 5. This causes it to change state until the arrival of the positive going edge of the signal SH immediately following the control impulse. At this moment, the outputs Q8 and $\bar{Q}8$ of the D flip-flop 8 also change state. The output $\bar{Q}8$ resets the RS flip-flop into its initial state. On the arrival of the negative going edge of the clock signal SH immediately following receipt of the control signal by the D flip-flop 8, only the input D9 of the D flip-flop 9 will present a logic potential 1 which will then pass to the output Q9, the output Q10 will present a O. Thus, the control signal given on the input S5 of the RS flip-flop circuit 5 is first of all memorized, it then passes to the output Q8 of the D flip-flop circuit 8 after which, it has to await a half period $^T/2$ of the clock signal SH for this information to pass to the output Q9 of the D flip-flop 9. For a control signal to be able to qualify as short, it is thus necessary that it lasts less than a half period $^T/2$ of the clock signal SH.

In the case of FIG. 3 as long as the control signal at the input S5 of the RS flip-flop 5 remains at a logic potential O, the output Q5 will remain at a logic potential 1 irrespective of the logic state O of its input R5. Upon the arrival of a negative going edge of the clock signal SH following receipt of the control signal by the flip-flop 8 the combination of the signals at the output Q5 and at the output Q8 via gate 12 give a logic potential 1 at input D10 of flip-flop 10 which passes to the output Q10. The output Q8 being likewise at 1, the output Q9 of the flip-flop 9 will also pass to 1. For a control signal to be able to qualify as long, it is thus necessary for it to last for more than one period of the clock signal SH. The control impulses the duration of which is comprised between ½ and 1½ period of the clock signal SH can either give a long call or a short call, following the moment of intervention in the sequence. This is inherent to the system.

The control circuits in accordance with the invention thus form a circuit having two outputs Q9 and Q10. An output 1,0 will signify: "short control signal" and the output 1,1 will signify: "long control signal". The memory circuit formed by the flip-flops 5 and 8 first of all memorizes the fact that one has pushed the pushbutton 1, then, at the moment of the transmission to the outputs Q9 and Q10 to the device, the logic function effected by the AND gate 12 indicates if the user still presses on the pushbutton 1 or not.

Figure 4:
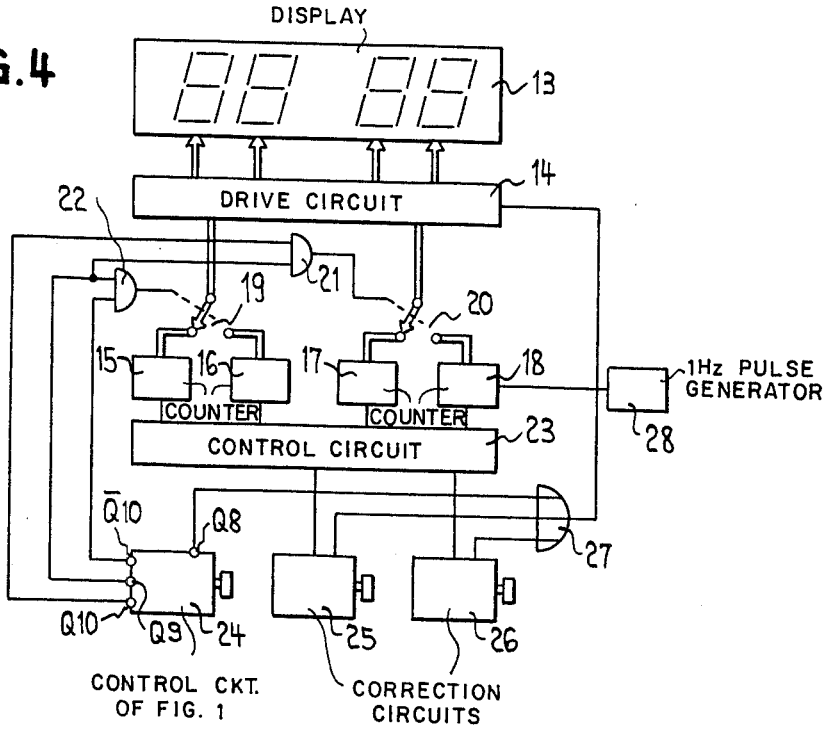
FIG. 4 illustrates a possible application of the device in accordance with the invention.

FIG. 4 illustrates one possible application of the control circuit in accordance with the invention, in an electronic watch having electrochromatic display where, permanently and normally, one can read the hour and the minute and where, on demand, one could display the date or the seconds. The choice between these two latter displays is effected by selecting the time of actuation of the button 1. The watch comprises a display 13 having four digits which receive their information via a drive circuit 14. Counters 15, 16, 17 and 18 for the hours, dates, minutes and seconds, respectively connectable to the drive circuit 14 by two switches 19 and 20 which either allow the information in the counters 15 and 17, namely hours and minutes, or the information in counters 16 and 18, namely date and seconds, to be displayed. These counters are fed by a counting circuit 28 which comprise a quartz crystal and a preliminary divider. The reference number 23 designates the control means for the counters 15 to 18. The circuits 25 and 26 are correction circuits, the first 25 is for the hours and the date, the second 26 is for the minutes and the return-to-zero of the seconds. These two circuits are operated by pushbuttons. The circuit 24 can have the form of a control circuit in accordance with the invention, illustrated in FIG. 1. The outputs Q9 and Q10 of the circuit of FIG. 1 feed the two inputs of an AND gate 21. At the same time the output Q9 and the output $\overline{Q10}$, complimentary to the output Q10, feed the two inputs of a second AND gate 22. The outputs of the gates 21 and 22 drive the switches 19 and 20. The outputs of these gates 21 and 22 are in accordance with the length of the application on the pushbutton, as follows:

| | Q9 | Q10 | $\overline{Q10}$ | AND gate 21 | AND gate 22. |
|---|---|---|---|---|---|
| Normal function | 0 | 0 | 1 | 0 | 0 |
| Short application | 1 | 0 | 1 | 0 | 1 |
| Long application | 1 | 1 | 0 | 1 | 0 |

Thus in normal functioning, the switches 19 and 20 will have the position illustrated in FIG. 4 and the watch will display the hour and the minute. It is to be noted that the control circuits are connected to an OR gate 27 the output of which feeds the drive circuit 14 of the display. These connections ensure, in the case of a manipulation of one of the pushbuttons, the erasing of the display, previous to all operation of change or of correction of this display. If one exercises a brief application on the push button of the circuit 24, only the switch 19 will change and the watch will display the date. If the application is long, only the switch 20 will change and the watch will display the seconds.

If one refers to FIG. 2 and 3, one can see that the output Q8 of the D flip-flop 8 changes state, in all cases, a half period of the clock signal SH before the control output Q9 and Q10. One could thus use this output Q8 to ensure the erasing of the display after which the discrimination between a long manipulation or a short manipulation is effected.

We claim:

1. A control device for electronic watches, comprising a push-button switch for providing a control signal, memory means having an input for receiving said control signal and an output, a memory signal appearing at said output of the memory means at least as long as said control signal is applied to said memory means, clock-controlled transfer means connected to said output of said memory means, said transfer means having output means connected to a reset input of said memory means for clock-controlled resetting of said memory means upon release of said switch and disappearance of said control signal, respectively, said output of said memory means and said output means of said transfer means being connected to a signal-combining circuit, and a first output circuit connected to said signal-combining circuit and a second output circuit connected to the output means of said transfer means, the state of the two output circuits varying in accordance with the duration of actuation of the pushbutton.

2. A control device according to claim 1, wherein said output circuits each include a clock-controlled transfer circuit for clock-controlled transmission of the output signals, clock control of said transfer circuits and of said transfer means being complementary so that transfer of output signals through said transfer circuits is effected at instants situated between a half period and one period of the clock signal after actuation of the pushbutton.

3. A control device according to claim 2, wherein said transfer means and said transfer circuits are D flip-flops.

4. A control device according to claim 1, wherein said signal-combining circuit is an AND-gate for logic multiplication of the two signals applied thereto.

5. In an electronic watch having electrochromatic display means, a control device comprising a pushbutton switch for providing a control signal, memory means for memorizing the control signal, a memory signal appearing at a memory output of said memory means, clock-controlled transfer means connected to said memory means for clock-controlled transmission of the memory signal, a reset input of said memory means being connected to an output of said transfer means for clock-controlled resetting of the memory means upon release of the pushbutton switch, logic signal-combining means having inputs connected to the input and output respectively of said transfer means, an output signal from said transfer means and an output signal from said logic signal-combining means being transmitted to output circuits, the state of such output circuits varying in accordance with the duration of the actuation of the pushbutton switch, both output signals from said output circuits being applied to a logic multiplier to operate a first switch for one display selection, and one output signal and the inverse of the other output signal being applied to another logic multiplier for operating a second switch for another display selection.

6. A control device for electronic watches, comprising a pushbutton switch for providing a control signal, memory means for memorizing said control signal, a memory signal appearing at an output of said memory means at least as long as said control signal is applied to said memory means, first clock-controlled transfer means connected to the output of said memory means and having output means connected to a resetting input of said memory means for clock-controlled resetting of said memory means and an output of said first transfer means being connected to a logic signal-combining circuit, and second and third clock-controlled signal-transfer means for respectively transferring the output signal from said first transfer means and the output signal from said signal-combining circuit to output terminals.

* * * * *